US006920995B2

(12) United States Patent
Bowen et al.

(10) Patent No.: US 6,920,995 B2
(45) Date of Patent: Jul. 26, 2005

(54) ADJUSTABLE HEIGHT COOLER

(75) Inventors: Andrew J. Bowen, Marietta, GA (US); Donald Kelemen, Royston, GA (US); David C. F. Stoddard, Atlanta, GA (US)

(73) Assignee: L & P Property Management Company, South Gate, CA (US)

( * ) Notice: Subject to any disclaimer, the term of this patent is extended or adjusted under 35 U.S.C. 154(b) by 164 days.

(21) Appl. No.: 10/317,655

(22) Filed: Dec. 12, 2002

(65) Prior Publication Data

US 2004/0112905 A1 Jun. 17, 2004

(51) Int. Cl.[7] ..... B65D 81/38

(52) U.S. Cl. ..... 220/592.1; 220/592.25; 220/915.2

(58) Field of Search ..... 248/146, 158; 220/507, 592.01, 592.02, 592.1, 592.25, 915.1, 915.2, 902; 62/457.7

(56) References Cited

U.S. PATENT DOCUMENTS

| | | | | | |
|---|---|---|---|---|---|
| 2,112,820 | A | * | 3/1938 | Winn | 62/320 |
| 3,632,012 | A | * | 1/1972 | Kitson | 220/592.06 |
| 3,958,359 | A | | 5/1976 | Doughty | |
| 4,042,142 | A | | 8/1977 | Ruano | |
| 4,403,483 | A | | 9/1983 | Lisalda | |
| 4,505,132 | A | | 3/1985 | Howes | |
| 4,505,408 | A | * | 3/1985 | Sagol | 222/185.1 |
| 4,546,900 | A | | 10/1985 | Lackey | |
| 4,724,682 | A | | 2/1988 | Flum | |
| 4,995,238 | A | | 2/1991 | King | |
| 5,048,171 | A | | 9/1991 | Bidwell | |
| 5,048,305 | A | | 9/1991 | Taub | |
| D329,378 | S | | 9/1992 | Bustos | |
| D329,599 | S | | 9/1992 | Bustos | |
| 5,169,020 | A | | 12/1992 | Spamer | |
| 5,577,344 | A | * | 11/1996 | Zaremba et al. | 47/39 |
| D407,609 | S | | 4/1999 | Rausch | |
| 5,910,162 | A | | 6/1999 | Harbour | |
| D450,926 | S | | 11/2001 | Dickinson | |
| D453,893 | S | | 2/2002 | Mount | |
| 2002/0162274 | A1 | * | 11/2002 | Jaworski | 47/39 |
| 2003/0150964 | A1 | * | 8/2003 | Sherer et al. | 248/146 |

* cited by examiner

*Primary Examiner*—Stephen Castellano
(74) *Attorney, Agent, or Firm*—Michael Best & Friedrich LLP

(57) ABSTRACT

A cooler suitable for indoor and outdoor use is provided. The cooler includes a container having a bottom surface, a first base connectable to the bottom surface of the container and a second base alternatively connectable to the bottom surface of the container. The cooler may include open-ended inner and outer containers nested and spaced so that a gap is created between the outer container and inner container, with foam insulation occupying the gap. The first base supports the cooler at a height suitable for use on a table, while the second base supports the cooler suitable for stand-alone use on the floor or ground. The first base can be nested within and hung from the second base while the cooler is in use or stored.

9 Claims, 9 Drawing Sheets

ADJUSTABLE HEIGHT COOLER

FIELD OF THE INVENTION

The present invention relates to systems and methods for displaying and chilling products in self-service retail environments and personal consumer environments. More particularly, the present invention relates to coolers for containing and displaying products and methods employing a cooler.

BACKGROUND OF THE INVENTION

Coolers are typically used to cool or chill products contained therein in a variety of manners, such as with ice, cold water, cooling coils, etc. These coolers can have a wide variety of designs having characteristics complementary to the unique purposes of the coolers. For example, coolers utilized in retail environments for chilling products, such as cans of soda, bottles of soda, meats, ice cream, or any other product requiring chilling, are designed to position the product so that it is easily viewable and accessible to consumers. These retail environment coolers may include stands or bases of substantial height to stand alone on the floor or ground for positioning the product in an easily viewable and accessible location.

Some coolers are alternatively designed for personal use. These coolers are typically designed for compactness and superior cooling capacity rather than for product viewability and aesthetics. People using coolers designed for personal use are typically not worried about how the cooler looks. Instead, they are concerned with the compactness of the cooler while the cooler is in use and when the cooler is being stored. Compact coolers consume a small amount of storage space, which is beneficial when storage space is limited (which is often the case). Compact coolers are therefore good candidates for personal use.

A need exists for an adjustable height cooler that can be conveniently used for retail and personal use on a tabletop or countertop or, alternatively, on the floor or ground. Ideally, the various components of the new cooler nest within one another during use or storage.

SUMMARY OF THE INVENTION

The present invention provides a cooler including an open-ended container and having a first base and second base that can be interchangeably connected to the bottom surface of the container. The first base selectively connects to the bottom surface of the container for supporting the container at a height that is appropriate when the cooler is placed on a tabletop or countertop. The second base selectively connects to the bottom surface of the container for supporting the container at a height that is appropriate for standing the cooler on the ground.

In one preferred embodiment, the invention is a cooler including an outer container defining a receptacle having an open end and an inner container defining a receptacle having an open end. The containers are nested and spaced so that a gap is defined between the outer container and the inner container. Foam insulation occupies the gap, the foam insulation adhering to both the outer container and the inner container so as to bond the containers together without the use of fasteners.

In another preferred embodiment, the invention is a cooler including a container and two bases. The container is in the shape of a receptacle having an open end, an exterior bottom surface and an interior bottom surface. Each of the bases includes an upper surface and a lower surface. Each of the bases is selectively connectable to the container to support the container at a distinctive height above a supporting surface. The shorter of the bases is adapted to nest within and depend from the taller of the bases while the cooler is being used or stored. The cooler has a first configuration in which the first surface of the base is connected to the exterior bottom surface of the container and the ground-contacting second surface of the base is engageable with the ground surface and a second configuration in which the first surface of the base contacts the interior bottom surface of the container and the ground-contacting second surface of the base is not engaging the ground surface.

In another aspect, the invention is a method of manufacturing a cooler. The method includes providing open-ended inner and outer containers, inserting the inner container into the outer container to create a gap between the outer container and the inner container, injecting foam insulation into the gap in a liquid state and transforming the foam insulation from a liquid state to a hardened state, which adheres the outer container to the inner container.

BRIEF DESCRIPTION OF THE DRAWINGS

The invention is further described with reference to the accompanying drawings, which show preferred embodiments. However, the invention is described and illustrated in the accompanying drawings by way of example only.

DETAILED DESCRIPTION OF THE PREFERRED EMBODIMENTS

Figure 1:
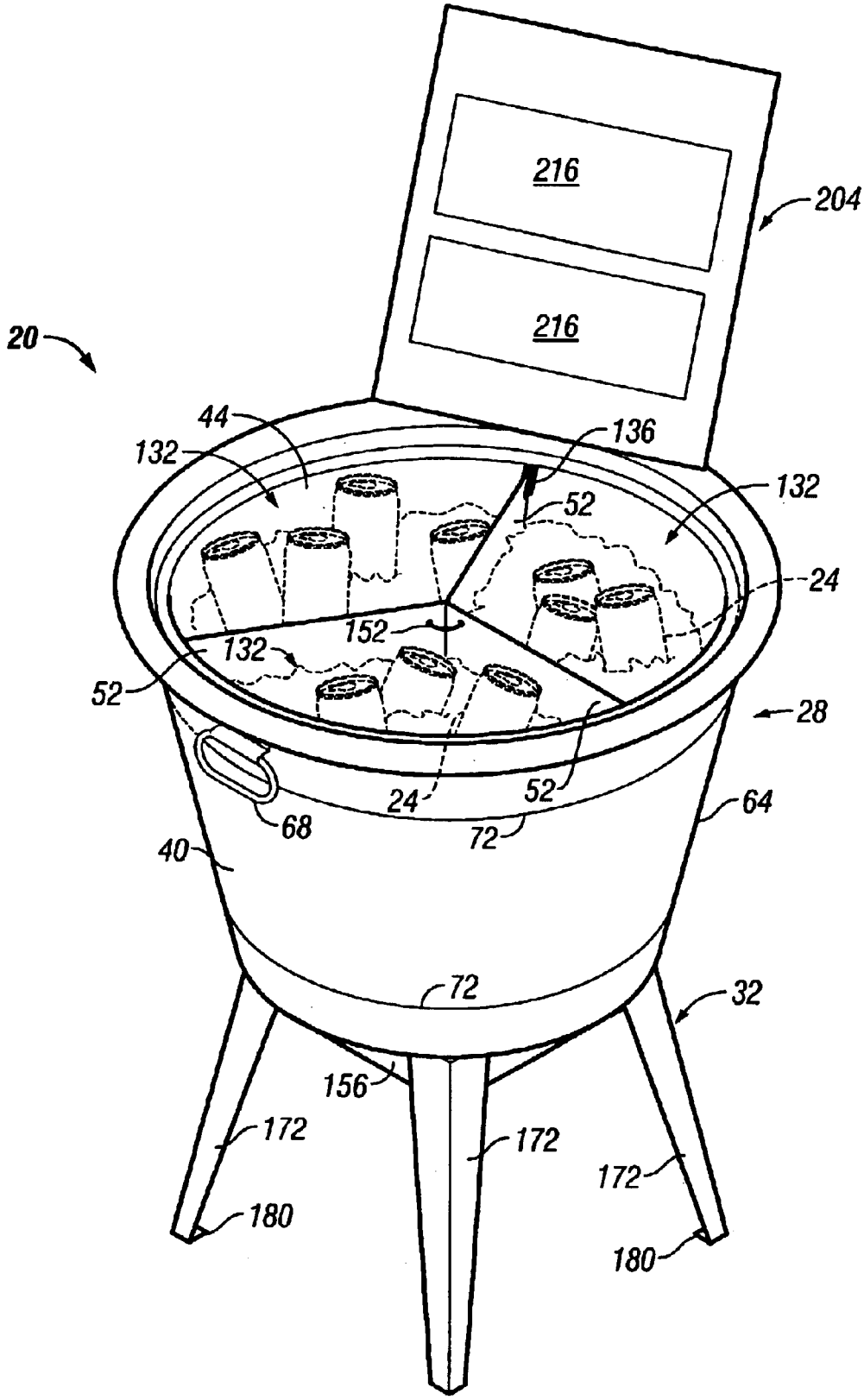
FIG. 1 is a perspective view of a cooler of the present invention, shown in a first configuration and with products contained and displayed therein in phantom.
Figure 2:
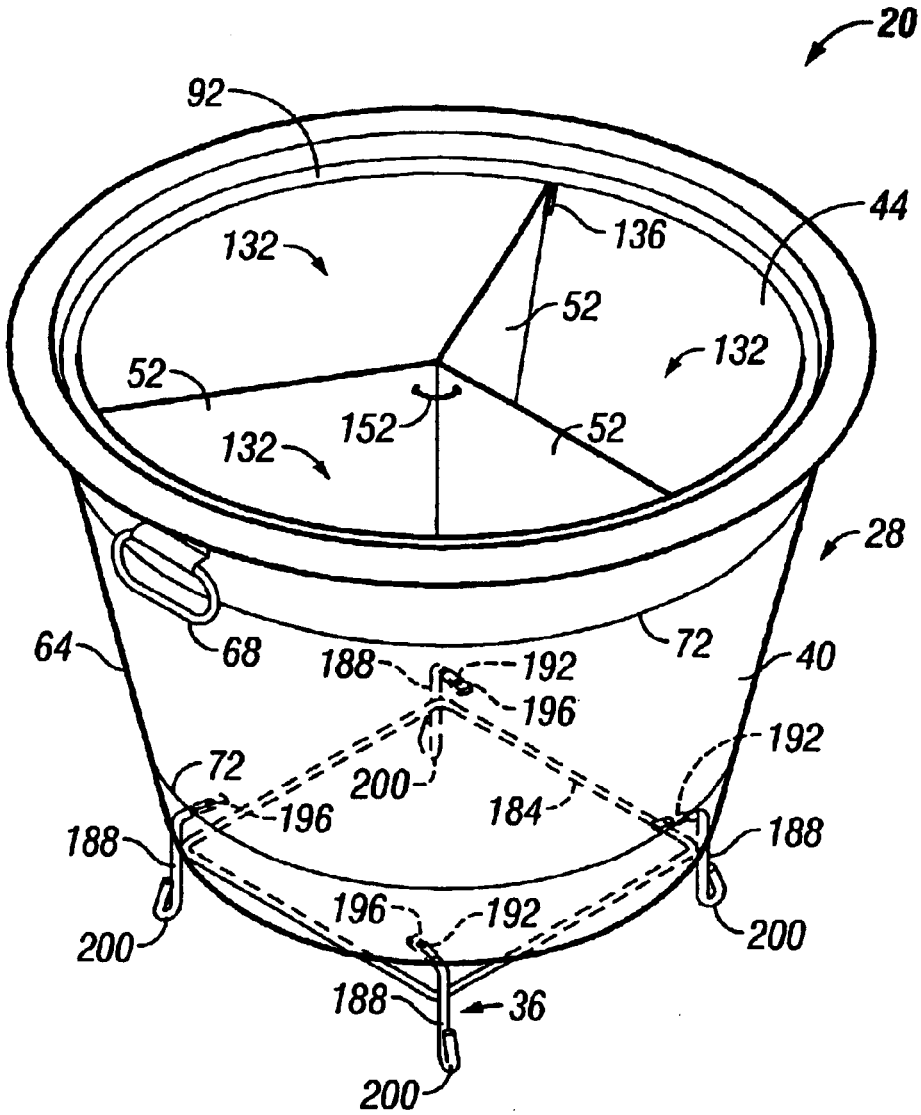
FIG. 2 is a perspective view of the cooler shown in FIG. 1, shown in a second configuration and without products.

An adjustable-height cooler 20 according to a preferred embodiment of the invention is shown in FIGS. 1 and 2. The cooler 20 can be used in many environments, such as, for example, a retail environment or a personal use environment for containing, chilling, and displaying products 24. "Product" or "products" means merchandise, packages, bottles, cans or any other items found in retail environments, personal use environments, or any other environments that may require a cooler.

"Retail environment" means any environment where products may be purchased or sold in retail lots, such as, for example, a grocery store, a gas station, a convenience store, a warehouse store, an outdoor festival or the like. "Personal use environment" means any environment where people use coolers for personal enjoyment, such as, for example, a picnic, a party or the like.

Cooler 20 is configurable in a first configuration, illustrated in FIG. 1, for retail environments and a second configuration, illustrated in FIG. 2, for personal use environments. In the first configuration, the cooler 20 is in a taller, stand-alone configuration, while in the second configuration, the cooler 20 is in a shorter, more compact configuration suitable for use on a tabletop or countertop. In the first configuration, products 24 are at a greater height with respect to a support surface than in the second configuration.

In the second configuration, the cooler 20 is relatively short and compact, which facilitates placement of the cooler 20 on tables, counters and in confined areas. Lower, more compact coolers are desirable in personal use environments when users want to keep the cooler on a table or out of sight altogether. In personal use environments, coolers 20 are in storage much of the time. Cooler 20 in the second configuration optimizes use of storage space. Cooler 20 can be converted from the second configuration for personal use environments to the first configuration for retail environments and vice-versa.

Figure 3:
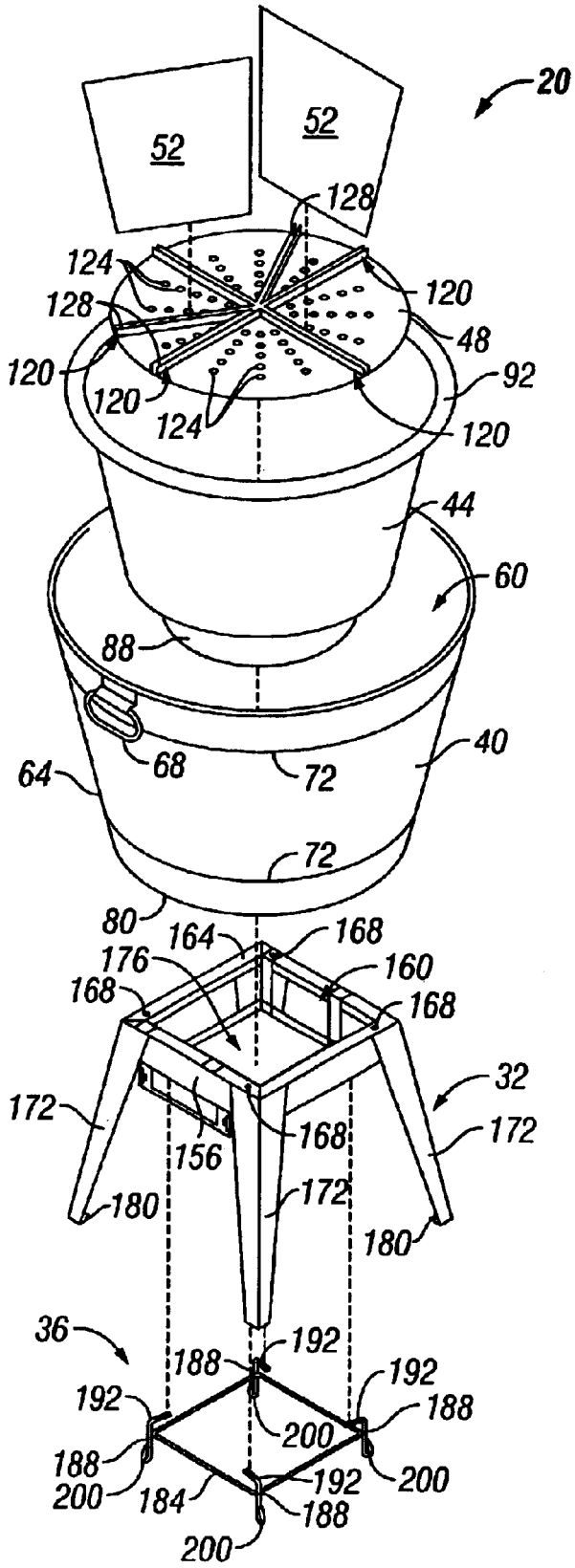
FIG. 3 is an exploded view of the cooler shown in FIG. 1.

Referring now to FIGS. 1, 2 and 3, the cooler 20 includes a container assembly 28, a taller base 32 and a shorter base 36. The taller base 32 and the shorter base 36 are selectively mountable to the container assembly 28 to configure the cooler 20 in the first configuration and the second configuration, respectively. The container assembly 28 includes an outer container 40, an inner container 44, an inner container floor 48, a plurality of dividers 52 and foam insulation 56 disposed between and adhered to both the outer and inner containers 40, 44.

Figure 4:
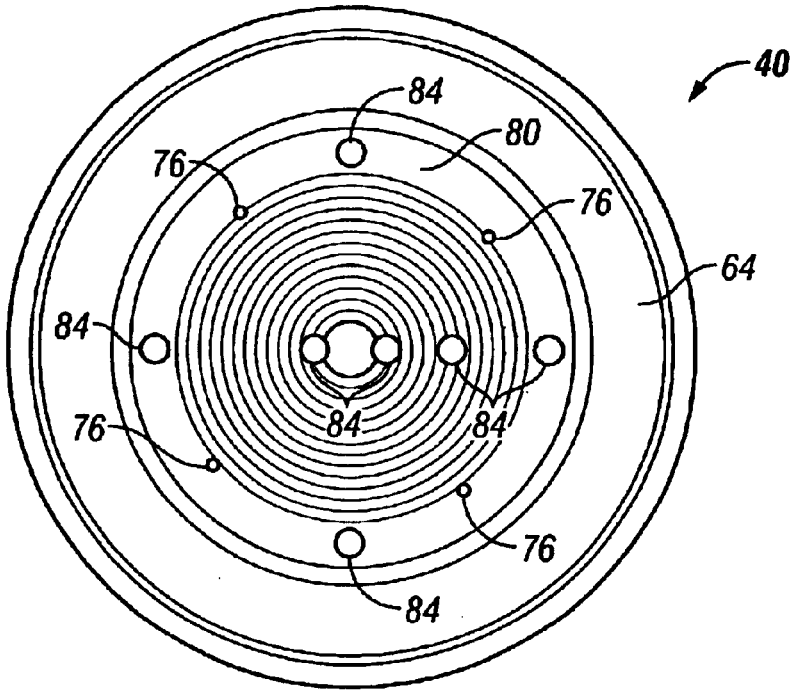
FIG. 4 is top view of an outer container of the cooler shown in FIG. 1.

With reference to FIGS. 3 and 4, the outer container 40 defines a receptacle 60 and includes a side wall 64, handles 68, strengthening ribs 72, a plurality of mounting apertures 76 and a plurality of injection apertures 84 defined through the bottom surface 80. Side wall 64 angles from an upper maximum diameter edge to a lower minimum diameter edge of the outer container 40 to provide the outer container 40 with a generally frusto-conical shape. However, the outer container 40 can take any shape, such as, for example, cylindrical, square or rectangular, yet still fall within the spirit and scope of the invention.

The handles 68 are coupled to the side wall 64 for lifting the outer container 40. In some embodiments of the invention, the outer container 40 does not include handles 68. The strengthening ribs 72 extend around the periphery of the outer container 40 to provide strength and rigidity to the outer container 40.

In some embodiments of the invention, the outer container 40 is formed of metal, such as, for example, galvanized steel or the like. In other embodiments of the invention, the outer container 40 is formed of plastic or the like.

Figure 5:
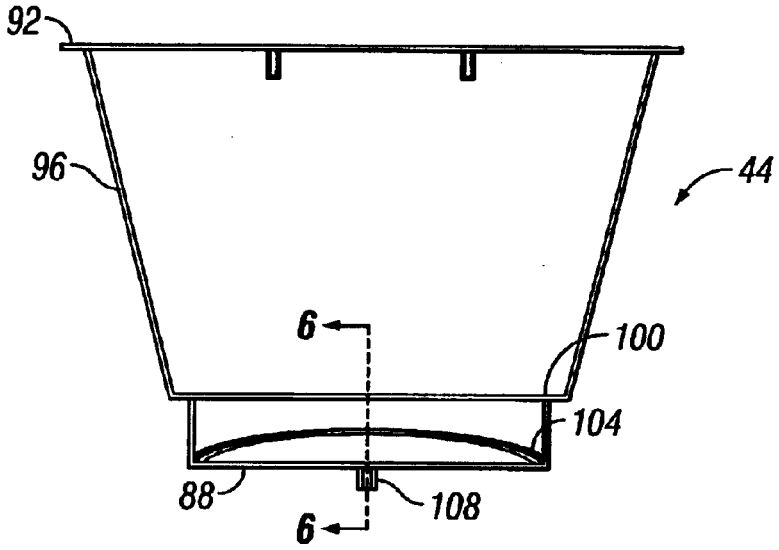
FIG. 5 is a front view of an inner container of the cooler shown in FIG. 1.
Figure 6:
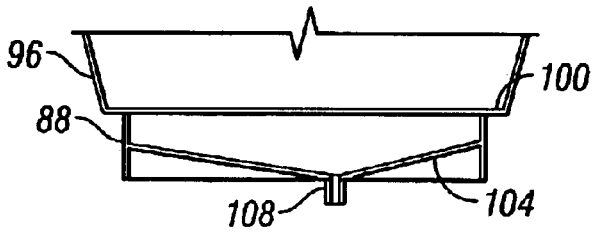
FIG. 6 is a cross-sectional view of the inner container shown in FIG. 5, taken along line 6—6.

Referring now to FIGS. 1, 5 and 6, the inner container 44 includes a base 88, an upper flange 92, a side wall 96, a lower flange 100, a slanted bottom surface 104 and a drain nozzle 108. The base 88 of the inner container 44 rests upon the bottom surface 80 of the outer container 40 and the upper flange 92 engages the side wall 64 of the outer container 40 when the inner container 44 is completely inserted into the outer container 40. The side wall 96 of the inner container 44 extends from the upper flange 92 to the lower flange 100 to provide the inner container 44 with a generally frusto-conical shape. However, the inner container 44 can take any shape yet still fall within the spirit and scope of the invention.

Figure 10:
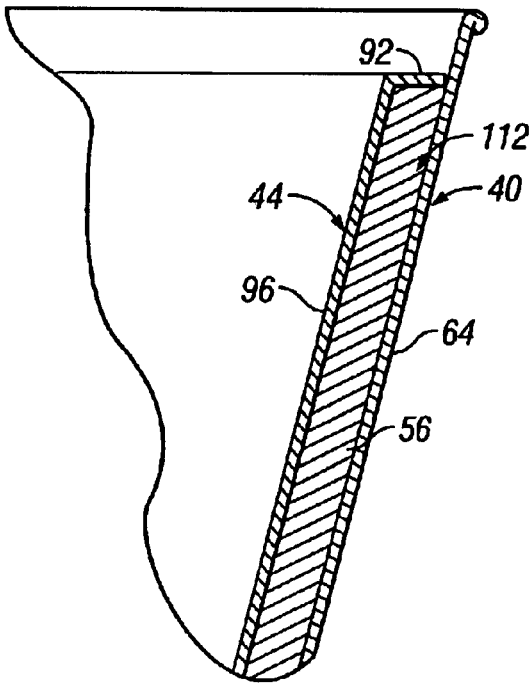
FIG. 10 is a cross-sectional view of the cooler shown in FIG. 9, taken along line 10—10.

In the illustrated embodiment of the invention, the side walls 64, 96 of the outer and inner containers 40, 44, respectively, are substantially parallel to each other and are spaced a distance from one another to provide a gap 112 (FIG. 10) therebetween. In some embodiments of the invention, the side walls 64, 96 of the outer and inner containers 40, 44, respectively, are not parallel to one another.

The slanted bottom surface 104 of the inner container 44 includes two generally planar intersecting surfaces generally angled toward one another to funnel liquid (discussed in greater detail below) toward the drain nozzle 108. The drain nozzle 108 extends downward from the intersection of the two generally planar surfaces to ensure that substantially all liquid drains through the drain nozzle 108. The drain nozzle 108 is positioned on the inner container 44 such that it is insertable through one of the plurality of injection apertures 84 defined through the bottom surface 80 of the outer container 40. Fluid drains out of the inner container 48, through the outer container 40, and away from the cooler 20.

In some embodiments of the invention, the inner container 44 includes multiple drain nozzles 108, which are insertable through multiple injection apertures 84. Preferably, the multiple drain nozzles 108 extend downward from the intersection of the two generally planar surfaces. However, the drain nozzles 108 can extend downward from any position on the slanted bottom surface 104.

The cooler 20 can also include a drain valve (not shown) connectable to the drain nozzle 108 to control the draining of fluids from the inner container 44. The drain valve can be directly connected to the drain nozzle 108 or can be connected to an intermediate draining device, such as, for example, a hose, tubing or the like, connected to the drain nozzle 108. Drain valves are well known in the art and, therefore, will not be discussed further herein.

With reference to FIG. 3, the inner container floor 48 includes an upper surface having a plurality of divider supports 120 positioned thereon, a bottom surface and a plurality of draining apertures 124 defined therethrough. The inner container floor 48 is insertable into the inner container 44 and the bottom surface thereof rests upon the lower flange 100 to position the floor 48 in an appropriate orientation. The plurality of divider supports 120 extend out from a center of the floor 48 and terminate at the periphery of the floor 48. Each divider support 120 includes a slot 128 into which a divider 52 is insertable (discussed in greater detail below). The divider supports 120 are operable to support dividers 52 in an upright manner to divide the inner container 44 into a plurality of compartments 132 (see FIG. 8).

Fluids from cooling items or products 24 supported on the inner container floor 48 are drained through the inner container floor 48 due to the plurality of draining apertures 124 defined therethrough. Such fluids from cooling items may include, for example, water from melted ice. The floor 48 can include any number of draining apertures 124 defined in any orientation on the floor 48 as long as fluids can drain through the floor 48. Preferably, the floor 48 includes at least one draining aperture 124 between each divider support 120.

Figure 7:
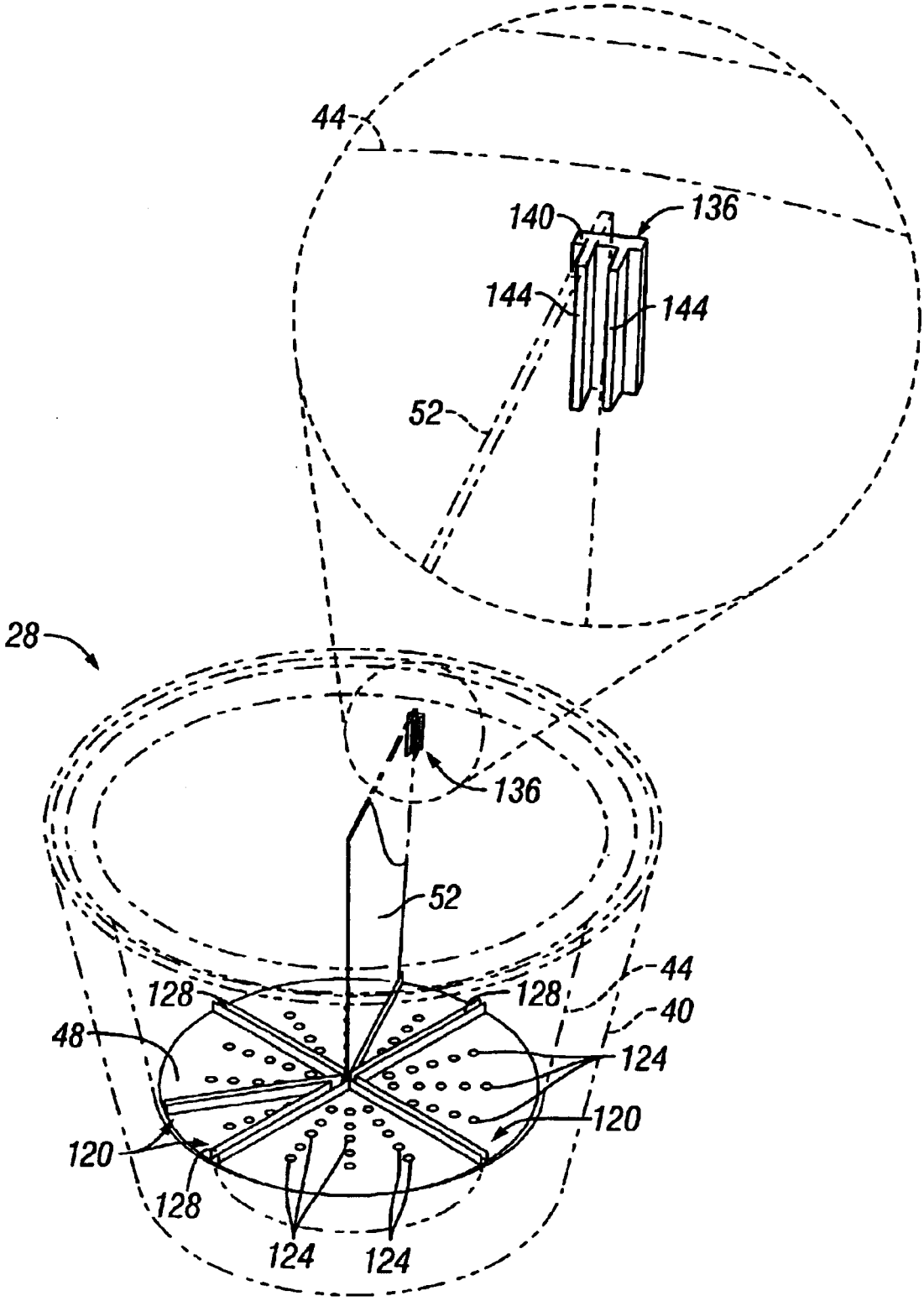
FIG. 7 is a detail view of an interior portion of the cooler shown in FIG. 1, shown with one divider.
Figure 8:
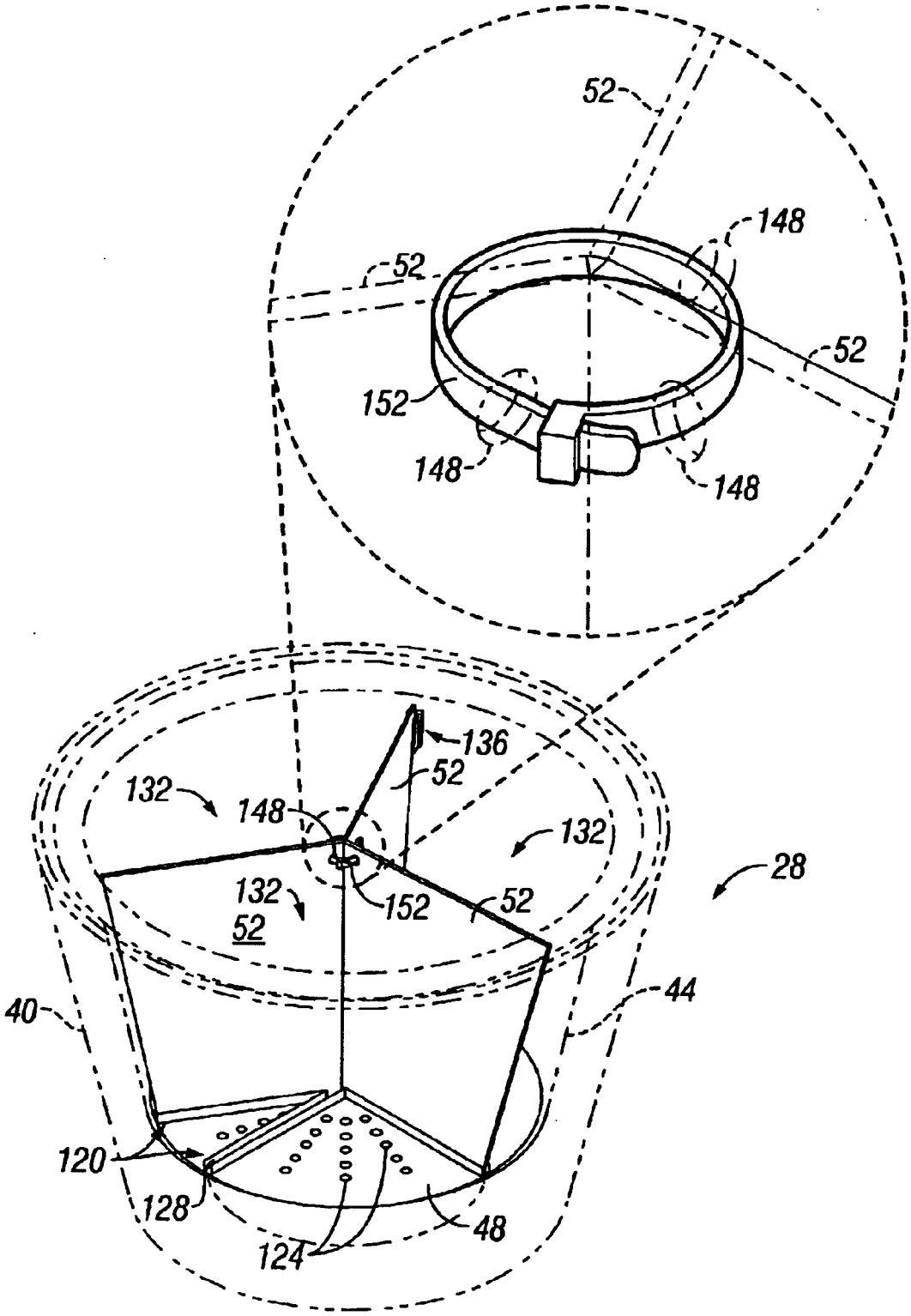
FIG. 8 is a detail view of an interior portion of the cooler shown in FIG. 1, shown with three dividers joined at adjacent ends.

Referring now to FIGS. 7 and 8, a bottom portion of each divider 52 is receivable within the slot 128 of a respective divider support 120 to support the bottom portion of the divider 52. A clip 136 is mounted to the interior of the inner container 44 to support an upper portion of each divider 52. In the illustrated embodiment, the clip 136 includes a mounting flange 140 having adhesive on an engaging surface thereof to adhesively mount the clip 136 to the inner container 44. The clip 136 also includes compression members 144 extending substantially perpendicular from the mounting flange 140 at a distance from one another. The compression members 144 are spaced so that a divider 52 can be inserted between the compression members 144 and resiliently retained. Resilient retention of the divider 52 is achieved by spacing the compression members 144 slightly less than the width of the divider 52.

In some embodiments of the invention, the clips 136 are integral with the inner container 44. In other embodiments of the invention, the clips 136 include compression members 144 that have inwardly extending (toward each other) clip projections that engage a divider projection. Upon initial insertion of the divider 52 between the compression members 144, the divider projection resiliently biases the clip projections apart. Once the divider projection completely passes the clip projections, the clip projections snap back toward each other to capture the divider projection between the clip projections and the inner container 44, preventing the top of the divider 52 from substantially moving relative to the inner container 44. The divider 52 can be disengaged from the clip 136 by sufficiently biasing the compression members 144 apart to release the divider projection. It should be noted that the clip 136 can take any form and can be mounted to the inner container 44 in any manner to support an upper portion of the divider 52 yet still fall within the spirit and scope of the present invention.

Each divider 52 also includes a securing aperture 148 defined therethrough (FIG. 8). In instances where multiple dividers 52 are inserted into the inner container 44, a securing element 152, such as, for example, a zip-tie, pad lock, rope, string, band, cable, wire or the like, is insertable through the securing apertures 148 of the dividers 52 to secure the dividers 52 together.

Figure 9:
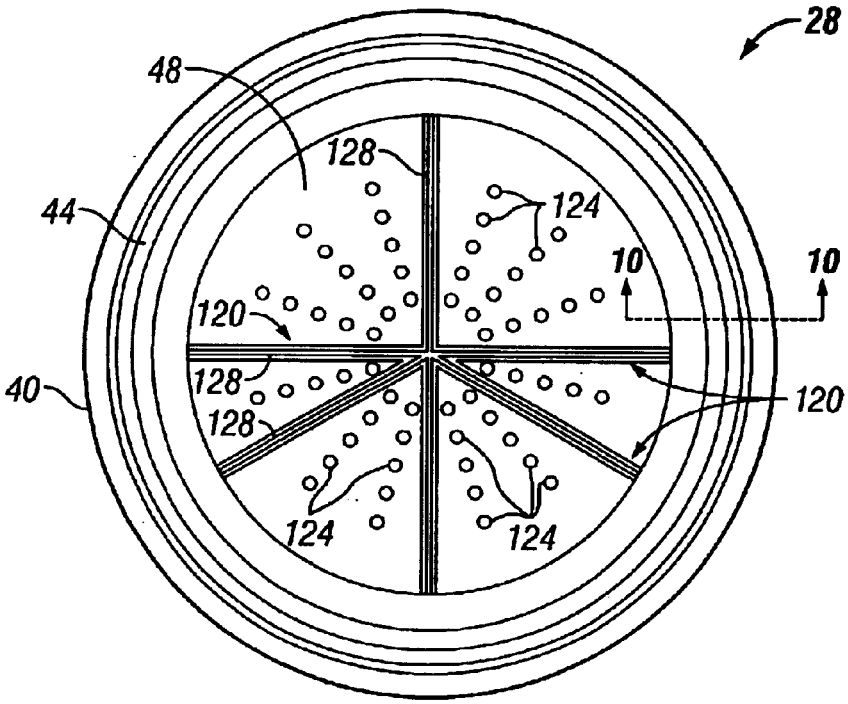
FIG. 9 is a top view of the cooler shown in FIG. 1.

With reference to FIGS. 8 and 9, the foam insulation 56 is disposed in the gap 112 between the outer and inner containers 40, 44 to insulate the inner container 44. The foam insulation 56 also adheres to both the outer and inner containers 40, 44 to bond them together. The process by which the foam insulation 56 is injected into the container assembly 28 is discussed below.

After the inner container 44 has been completely inserted into the outer container 40, the foam insulation 56 is injected into the gap 112 in liquid form. The liquid foam insulation 56 is injected into the gap 112 through the plurality of injection apertures 84, which extend through the bottom surface 80 of the outer container 40. The injection apertures 84 are oriented appropriately to facilitate generally equal disbursement of the liquid foam insulation 56 throughout the gap 112. Liquid foam insulation 56 can be injected though all the injection apertures 84 except the aperture 84 through which the drain nozzle 108 extends. After injection, the foam insulation 56 changes from the liquid form to its hardened form, in which the foam insulation 56 adheres or sticks to both the outer container 40 and the inner container 44 to bond the outer and inner containers 40, 44 together. Because the foam insulation 56 adheres to both containers, no fasteners or other securing devices are necessary to bond the outer and inner containers 40, 44 together.

Figure 11:
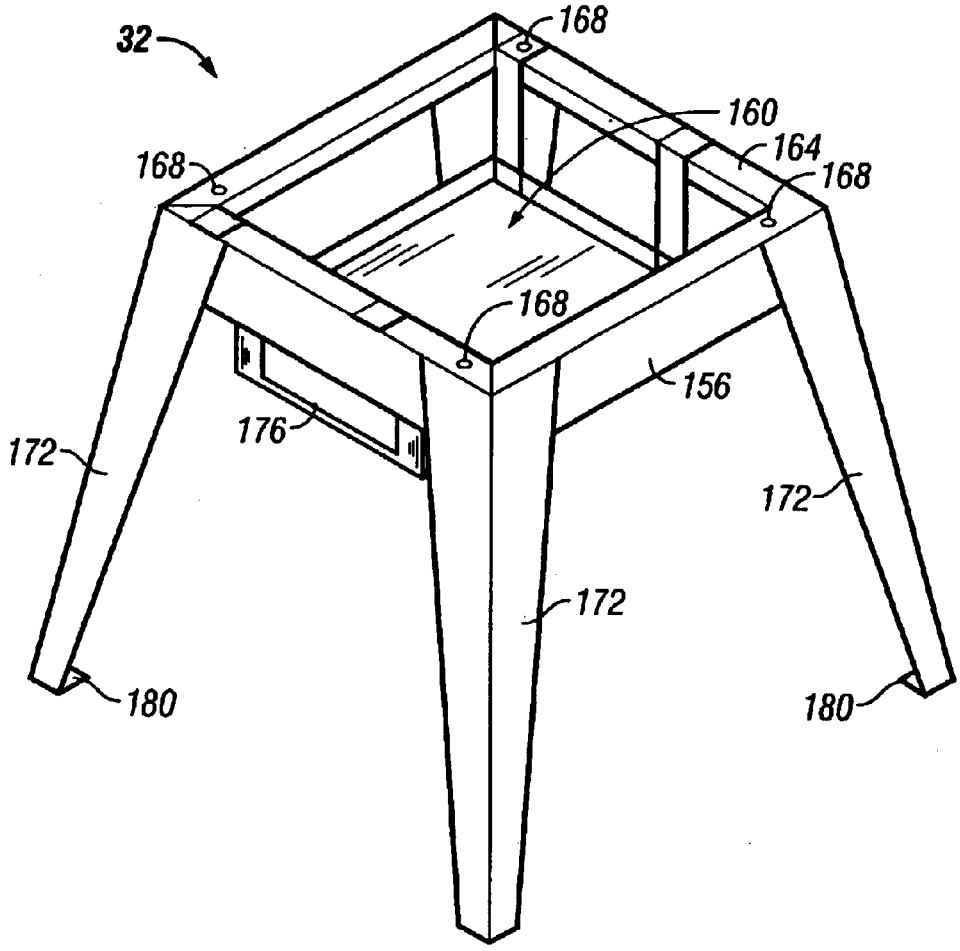
FIG. 11 is a perspective view of a taller base of the cooler shown in FIG. 1.

With reference to FIG. 11, the taller base 32 includes a frame 156 having a central opening 160 and a mounting flange 164 through which a plurality of mounting apertures 168 are defined, a plurality of support legs 172 mounted to the frame 156 and extending downward therefrom and a tray 176. The plurality of mounting apertures 168 are positioned around the mounting flange 164 for aligning with mounting apertures 76 defined through the bottom surface 80 of the outer container 40. A fastener (not shown) is insertable through each set of aligned mounting apertures 76, 168 to selectively mount the taller base 32 to the outer container 40. In the illustrated embodiment of the invention, the mounting flange 164 defines four mounting apertures 168. However, the mounting flange 164 can define any number of mounting apertures 168 yet still fall within the spirit and scope of the invention.

Each of the plurality of support legs 172 is mounted to a corner of the frame 156 and extends downward therefrom, terminating with a support foot 180 that contacts the ground surface to provide support to the cooler 20 when in the first configuration. In the illustrated embodiment of the invention, the taller base 32 includes four support legs 172 (only three legs 172 shown) extending from the corners of the frame 156. However, if the cooler 20 is supported in a manner that prevents the cooler 20 from tipping or collapsing under normal operating conditions, the taller base 32 can include any number of support legs 172 mounted anywhere on the frame 156.

In the illustrated embodiment of the invention, the tray 176 is integral with the mounting flange 164 and is positioned under a portion of the central opening 160. The tray 176 is suitable for supporting draining equipment (not shown), such as, for example, a hose or tubing, which is connectable to the drain nozzle 108. The draining equipment receives fluid from the drain nozzle 108 and drains fluid away from the cooler 20. The draining equipment can be spooled, rolled, wrapped up, folded or the like and placed on the tray 176 for storage. In some embodiments of the invention, the tray 176 is selectively mounted to the mounting flange 164 with fasteners. In these embodiments, the tray 176 can be removed from the taller base 32 if so desired.

Figure 12:
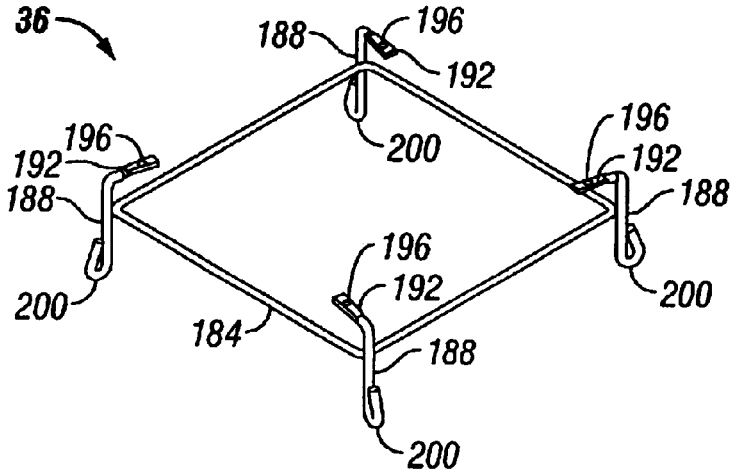
FIG. 12 is a perspective view of a shorter base of the cooler shown in FIG. 2.

Referring now to FIGS. 2, 3 and 12, the shorter base 36 includes a frame 184 and a plurality of legs 188 mounted to the frame 184. Each of the plurality of legs 188 includes a mounting member 192 having a mounting aperture 196 defined therethrough and a support foot 200 that contacts the floor, ground surface or other support to provide support to the cooler 20 when in the second configuration. The plurality of mounting apertures 196 are positioned for aligning with one of the mounting apertures 76 of the outer container 40. A fastener is insertable through each set of aligned mounting apertures 76, 196 to selectively mount the shorter base 36 to the outer container 40. Similarly, the mounting apertures 196 of the shorter base 36 are positioned in a complementary manner to the mounting apertures 168 of the taller base 32. Preferably, the shorter base 36, taller base 32 and outer container 40 all have the same number of mounting apertures.

To arrange the cooler 20 in the first configuration, the mounting flange 164 of the taller base 32 is brought into contact with the bottom surface 80 of the outer container 40 such that the mounting apertures 76, 168 of both the outer container 40 and the taller base 32 align. Next, the mounting members 192 of the shorter base 36 are brought into contact with the underside of the mounting flange 164 such that the mounting apertures 196 of the shorter base 36 align with the mounting apertures 76, 168 of both the outer container 40 and the taller base 32. Finally, a fastener is inserted through each set of aligned mounting apertures 76, 168, 196 to mount the taller base 32 to the bottom surface 80 of the outer container 40 and the shorter base 36 to the underside of the taller base 32. In this manner, the shorter base 36 is nested within the taller base 32 for storage. In the first configuration of the cooler 20, the taller base 32 supports the container assembly 28 and the products 24 contained therein a first distance above the ground surface.

To arrange the cooler 20 in the second configuration, the shorter base 36 is mounted to the outer container 40 (rather than the taller base 32 as in the first configuration of the cooler 20) by bringing the mounting members 192 of the shorter base 36 into contact with the bottom surface 80 of the outer container 40 such that the mounting apertures 196 of the shorter base 36 align with the mounting apertures 76 of the outer container 40. Next, fasteners are inserted through each set of aligned mounting apertures 76, 196 to mount the shorter base 36 to the outer container 40. In the second configuration of the cooler 20, the shorter base 36 supports the container assembly 28 and the products 24 contained therein a second distance (less than the first distance) above the floor, ground surface or other support. The taller base 32 is not utilized in the second configuration of the cooler 20.

Referring back to FIG. 1, the cooler 20 also includes a header 204 mounted to the container assembly 28 for advertising or informational purposes. The header 204 is positioned so that consumers can easily view the header 204 as they pass by the cooler 20. In some embodiments of the invention, the header 204 includes a frame having ends insertable into holes defined in the upper flange 92 of the inner container 44. The header 204 also includes at least one retail space 216 thereon that can contain information, such as, for example, advertisements, product identification, product information or the like. In other embodiments of the invention, the header 204 can be mounted to the outer container 40 of the cooler 20. In further embodiments of the invention, the header 204 can be mounted to either or both the taller base 32 and the shorter base 36.

Figure 13:
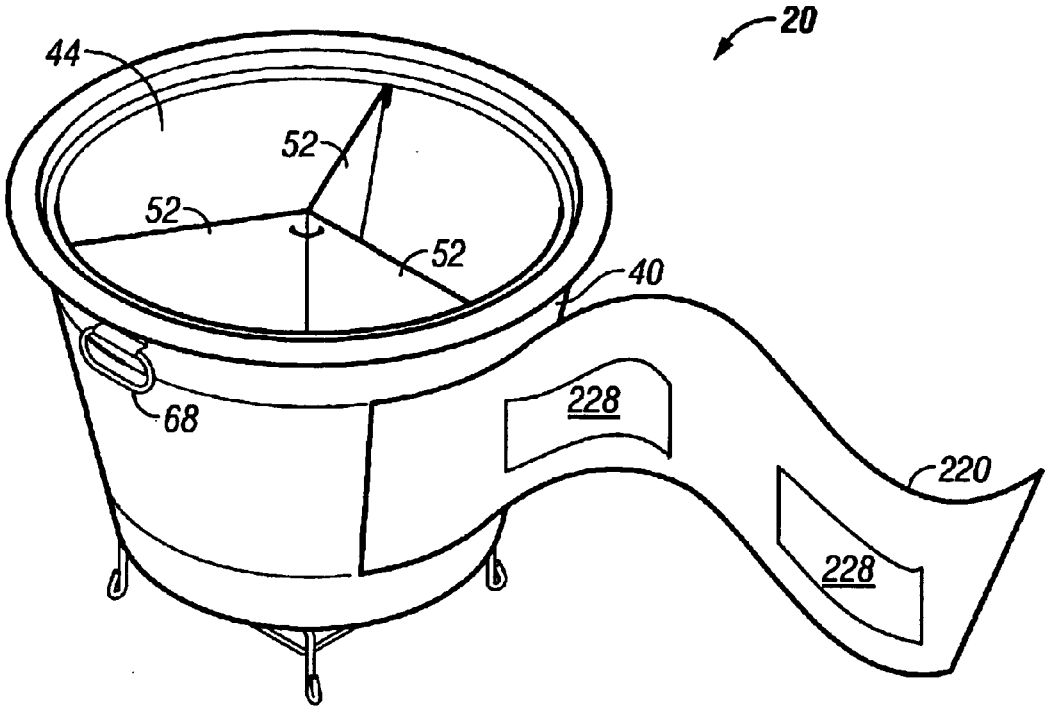
FIG. 13 is a perspective view of the cooler shown in FIG. 9, shown with a graphics wrap partially wound around the cooler.
Figure 14:
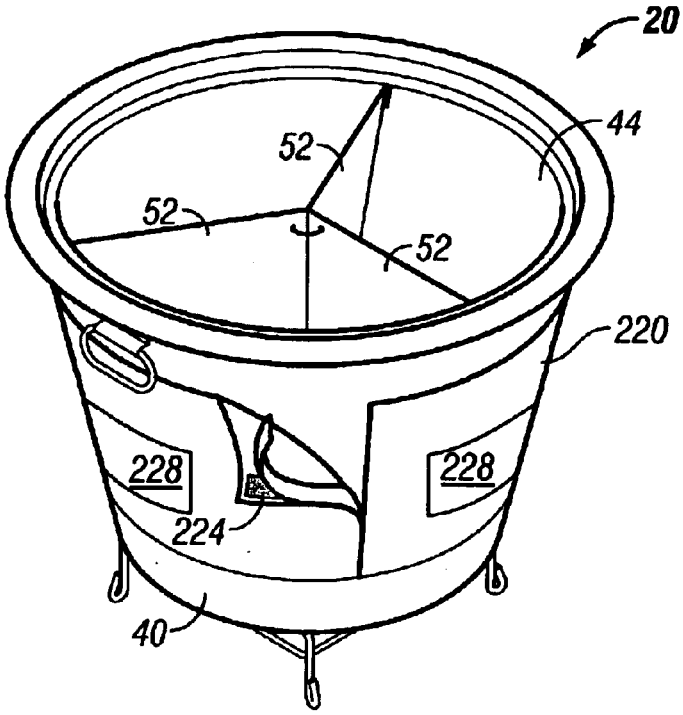
FIG. 14 is a perspective view of the cooler shown in FIG. 13, shown with the graphics wrap on the cooler with a portion thereof peeled back.

Referring now to FIGS. 13 and 14, the cooler 20 also includes a graphics wrap 220 connectable to the outer container 40 for advertising or informational purposes. The graphics wrap 220 can contain graphics, wording, numbering or any other information for viewing by consumers. In the illustrated embodiment of the invention, the graphics wrap 220 includes an adhesive strip 224 on one end thereof for adhesively connecting the one end of the graphics wrap 220 to another end of the graphics wrap 220 after wrapping the graphics wrap 220 around the outer container 40. Additionally, the graphics wrap 220 includes at least one retail space 228 thereon that can contain information, such as, for example, advertisements, product identification, product information or the like. Handle cutouts (not shown) are also included in the graphics wrap 220 to prevent contact between the graphics wrap 220 and the handles 68 of the outer container 40 when the graphics wrap 220 is wrapped around the outer container 40. It should be noted that the ends of the graphics wrap 220 can be connected together in any manner and still fall within the spirit and scope of the present invention.

In some embodiments of the invention, the graphics wrap 220 can be supported from below and above by a lower lip and an upper lip, respectively, protruding from a bottom edge and a top edge, respectively, of the outer container 40. In these embodiments, the lips protrude sufficiently to prevent the graphics wrap from sliding past the lips and falling off the outer container 40. In other embodiments of the invention, the graphics wrap 220 includes additional adhesive strips disposed on an interior side thereof for engaging the outer container 40 to adhesively connect the graphics wrap 220 to the outer container 40. In further embodiments of the invention, the graphics wrap 220 is cinched tightly around the outer container 40 and the ends thereof are connected in any manner. In these embodiments, the cinching of the graphics wrap is sufficient to hold the graphics wrap 220 on the outer container 40.

In some embodiments of the invention, the cooler 20 is configurable in a storage configuration. It is desirable to configure the cooler 20 in the storage configuration when the cooler 20 is not in use and when the cooler 20 is being placed into storage. In the storage configuration, the cooler 20 occupies less space than it does in both the first and second configurations.

The cooler 20 is configurable in the storage configuration by removing the taller base 32 and the shorter base 36 from the container assembly 28 and removing the dividers 52 from within the inner container 44. The shorter base 36 is nested within the taller base 32 and then both the taller base 32 and shorter base 36 are flipped upside down such that the frame 156 is below the plurality of legs 172, which extend upward from the frame 156. The taller base 32 and shorter base 36 are then inserted into the inner container 44 until the mounting flange 164 of the taller base 32 rests upon the inner container floor 48. At this point, the taller base 32 is supported on the inner container floor 48 and the shorter base 36 is supported on the opposite side of the mounting flange 164 from the side that contacts the inner container floor 48. If dividers 52 are used with the cooler 20, they can be inserted into the inner container 44 and rest upon the taller base and/or the shorter base in a position between the plurality of legs 172.

There has been described, with reference to specific exemplary embodiments thereof, a merchandise display cooler. It will be apparent to those skilled in the art that modifications may be made without departing from the spirit and scope of the invention. All modifications are considered within the spirit and scope of the present invention. The specification and drawings, therefore, are to be regarded in an illustrative rather than restrictive sense.

What is claimed is:

1. A cooler for containing and displaying products, the cooler comprising:

an outer container defining a receptacle having an open top providing access to an interior of the cooler;

an inner container defining a receptacle having an open top providing access to the interior of the cooler and being positioned within the receptacle of the outer container such that a gap is defined between at least a portion of the outer container and at least a portion of the inner container, the products being contained and displayed within the inner container, foam insulation occupying the gap defined between the outer container and the inner container, the foam insulation defining a fastener and adhering to both the outer container and the inner container to bond the outer container and inner container together without the use of additional fasteners; and a base coupled to the outer container and supportable upon a support surface for supporting the outer and inner containers at a height above the support surface and in which the open top is oriented in a substantially upward direction.

2. The cooler as claimed in claim 1, wherein the outer container is made substantially of metal and the inner container is made substantially of plastic.

3. The cooler as claimed in claim 1, wherein the outer container includes at least one aperture defined therethrough and the foam insulation has a liquid state and a hardened state, and wherein the foam insulation is injected in the liquid state through the at least one aperture into the gap, the foam insulation transforming into the hardened state and adhering to both the outer container and the inner container after being injected into the gap.

4. The cooler as claimed in claim 1, further comprising a plurality of dividers insertable into the receptacle of the inner container to divide the receptacle of the inner container into a plurality of smaller receptacles.

5. The cooler as claimed in claim 4, wherein each of the plurality of dividers includes a securing aperture defined therethrough, the cooler further comprising a securing element insertable through each of the securing apertures to secure the plurality of dividers together.

6. The cooler as claimed in claim 1, wherein the base is a first base, the cooler further comprising a second base, the first base being selectively connectable to the outer container and supportable on a ground surface for supporting the outer container a first distance from the ground surface, the second base being selectively connectable to the outer container and supportable on a ground surface for supporting the outer container a second distance from the ground surface, the second distance being greater than the first distance, the first base and the second base being interchangeably connected to the container.

7. The cooler as claimed in claim 6, wherein the first base includes a plurality of legs having a first length and the second base includes a plurality of legs having a second length, the second length being greater than the first length.

8. The cooler as claimed in claim 6, wherein the second base includes a mounting flange having a top side and a bottom side, the top side engageable with the outer container when the second base is connected to the outer container, and wherein the first base is connectable to the bottom side of the mounting flange when the second base is connected to the outer container, the first base being out of contact with the ground surface when connected to the mounting flange of the second base.

9. The cooler as claimed in claim 6, wherein the first base is selectively connectable to and nestable within the second base when the second base is connected to the container.

* * * * *